United States Patent [19]

Daman et al.

[11] 4,423,912

[45] Jan. 3, 1984

[54] ARRANGEMENT FOR MOUNTING A CONVERTIBLE BED SEWING MACHINE IN A FLAT BED CABINET

[75] Inventors: Louis F. Daman, Warren Township, Somerset County; Albert L. Newman, West Orange; John Patricia, Elizabeth, all of N.J.

[73] Assignee: The Siner Company, Stamford, Conn.

[21] Appl. No.: 377,722

[22] Filed: May 13, 1982

[51] Int. Cl.[3] ..... A47F 5/08

[52] U.S. Cl. ..... 312/30; 312/23; 312/21

[58] Field of Search ..... 312/22, 23, 30; 112/217.1, 217.2, 217.3, 217.4

[56] References Cited

U.S. PATENT DOCUMENTS

| | | | |
|---|---|---|---|
| 2,318,443 | 5/1943 | West | 312/30 |
| 2,398,696 | 4/1946 | Colegrove | 112/217.1 X |
| 2,874,074 | 2/1959 | Perrinjaquet | 312/30 |
| 3,788,716 | 1/1974 | Roberts et al. | 312/22 X |
| 4,194,799 | 3/1980 | White | 112/217.1 |
| 4,274,686 | 6/1981 | White | 112/217.1 X |
| 4,312,549 | 1/1982 | Ravenelle | 312/23 |

*Primary Examiner*—James T. McCall
*Assistant Examiner*—Joseph Falk
*Attorney, Agent, or Firm*—David L. Davis; E. L. Bell; Robert E. Smith

[57] ABSTRACT

An arrangement for adapting a flat bed sewing machine to support a convertible bed sewing machine for flat bed sewing includes a support bracket assembly and a support arm assembly which both extend into the cavity of the sewing machine. The sewing machine is fixedly mounted on the support bracket assembly for supporting the rear of the sewing machine. The support arm assembly supports the front end of the sewing machine and swings out of the way when not supporting the sewing machine to provide clearance for the sewing machine when the sewing machine is in its stored position within the cavity of the cabinet.

4 Claims, 3 Drawing Figures

ARRANGEMENT FOR MOUNTING A CONVERTIBLE BED SEWING MACHINE IN A FLAT BED CABINET

DESCRIPTION

BACKGROUND OF THE INVENTION

This invention relates to sewing machine cabinets in general and, more particularly, to an arrangement for mounting a convertible bed sewing machine in a flat bed cabinet.

Sewing machines are typically mounted within a cabinet which allows the sewing machine either to be stored in a concealed lower position when it is not in use or supported in an upper operative position. It is not considered unusual for the owner of the sewing machine and cabinet to replace an older sewing machine with an upgraded model having more features while still keeping the same cabinet. Many of these older models are sewing machines of the flat bed type wherein the bed has an overhanging lip completely surrounding the base of the sewing machine, and which lip is utilized to support the sewing machine in its operative position where the bed is substantially coplanar, or flush, with the work supporting surface defined by the cabinet. In contrast, many of the upgraded models are of the convertible bed type with no such overhanging lip, but rather have a relatively gently sloping surface from the bed down to the lower extremity of the base of the machine. There are applications where it is desirable to have the machine with upgraded features but not utilize the convertible bed feature. For example, many schools which have sewing classes desire to teach the students on the upgraded models but do not wish the students to have anything more than a flat bed machine. These schools are typically conservative in their expenditures and would prefer to be able to keep their older cabinets. It would therefore be desirable to have an arrangement for mounting a convertible bed sewing machine of the aforedescribed type in a flat bed cabinet.

It is therefore an object of the present invention to provide an arrangement for mounting a convertible bed sewing machine in a flat bed cabinet.

SUMMARY OF THE INVENTION

The foregoing and additional objects are attained in accordance with the principles of this invention by providing an arrangement for mounting a convertible bed sewing machine in a flat bed cabinet. The cabinet is of the type having a cavity for storing a sewing machine when not in use, a fixed work supporting surface, and a hinged work supporting surface adapted to be upwardly pivoted from a position where it is substantially coplanar with the fixed work supporting surface so as to allow a sewing machine to be pivoted between a stored position within the cavity and an operative position with its bed substantially coplanar with the fixed work supporting surface. The arrangement according to the present invention supports the sewing machine from its base a substantial distance below the sewing machine bed. The arrangement includes a support bracket assembly mounted on the cabinet and extending into the cavity, the support bracket assembly including means for fixedly mounting the sewing machine base thereon and pivot means defining the pivoting motion of the sewing machine between the stored and operative positions. The arrangement further includes a support arm assembly mounted on the hinged work supporting surface, the support arm assembly including a support arm adapted to be extended to a first position so as to support the sewing machine base when the hinged work supporting surface is substantially coplanar with the fixed work supporting surface and the sewing machine is in its operative position, the support arm assembly further including means for retracting the support arm to a second position when the sewing machine is moved from its operative position so as to provide clearance for the sewing machine when the sewing machine is in its stored position and the hinged work supporting surface is substantially coplanar with the fixed work supporting surface.

BRIEF DESCRIPTION OF THE DRAWINGS

The foregoing will be more readily apparent upon reading the following description in conjunction with the drawings in which like reference characters in different figures thereof denote like elements and wherein.

DETAILED DESCRIPTION

Figure 1:
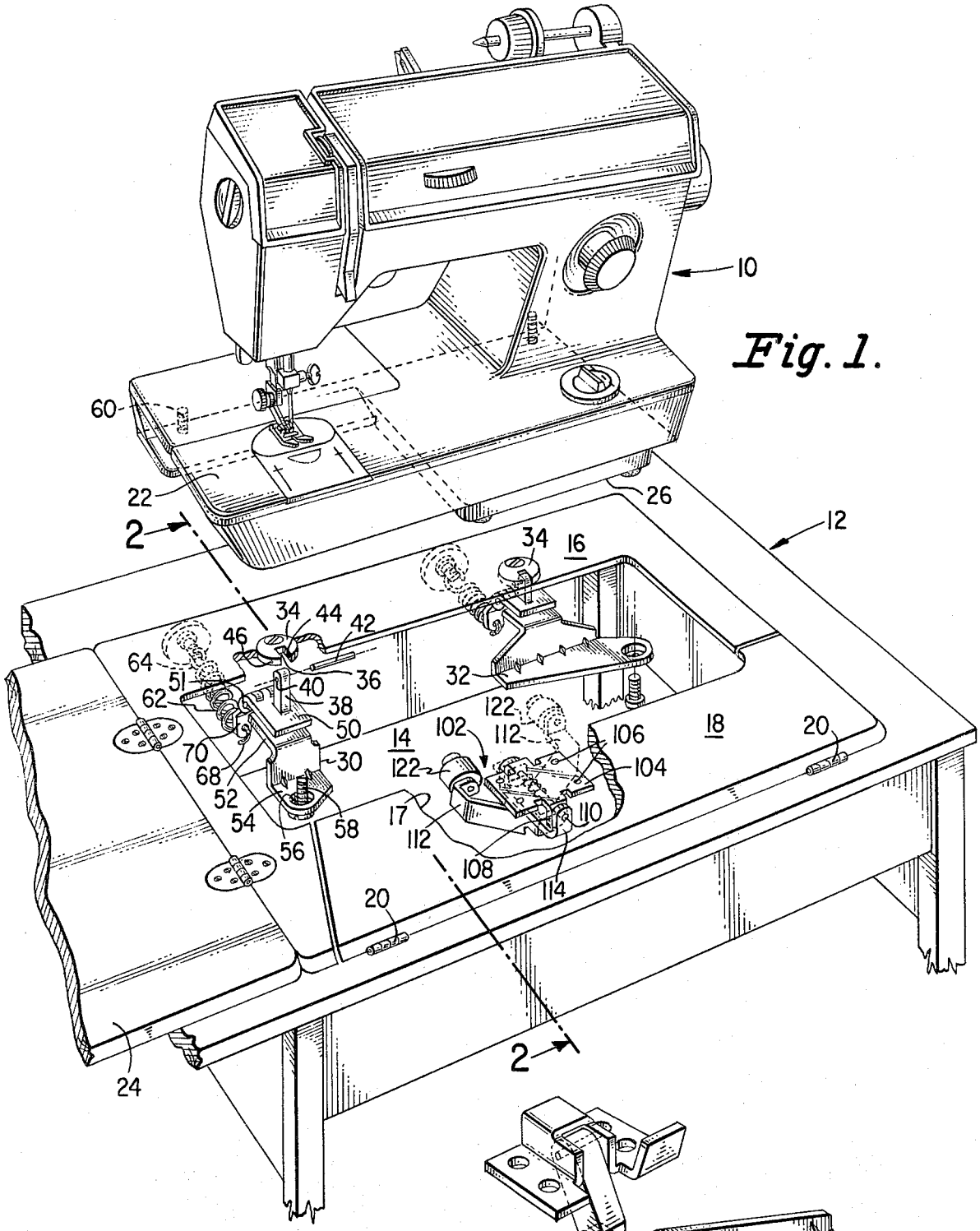
FIG. 1 is an exploded perspective illustration, generally from above and in front, and partially broken away, showing a flat bed sewing machine cabinet having installed therein an arrangement constructed in accordance with the principles of this invention for mounting a convertible bed sewing machine having the general configuration shown in FIG. 1.

Referring now to the drawings, FIG. 1 shows an exploded perspective view, partially cut away, of a convertible bed sewing machine, designated generally by the reference numeral 10, and a flat bed cabinet, designated generally by the reference numeral 12, which is adapted to have the sewing machine 10 mounted therein. The cabinet 12 has a cavity 14 for concealed storage of the sewing machine 10 when it is not in use. Above the cavity 14 the cabinet 12 has a fixed work supporting surface 16 and a hinged flap 17 having a work supporting surface 18. The hinged flap 17 is adapted to be upwardly pivoted about the hinges 20 from a position, as shown in FIG. 1, where the work supporting surface 18 is substantially coplanar with the fixed work supporting surface 16 so as to allow the sewing machine 10 to be pivoted between a stored position within the cavity 14 and an operative position with the bed 22 of the sewing machine 10 substantially coplanar with the fixed work supporting surface 16, as will be described in more detail hereinafter. The cabinet 12 may also include a hinged cover member 24 adapted to cover the cavity 14 when the sewing machine 10 is in its stored position so as to conceal same from view.

Figure 2:
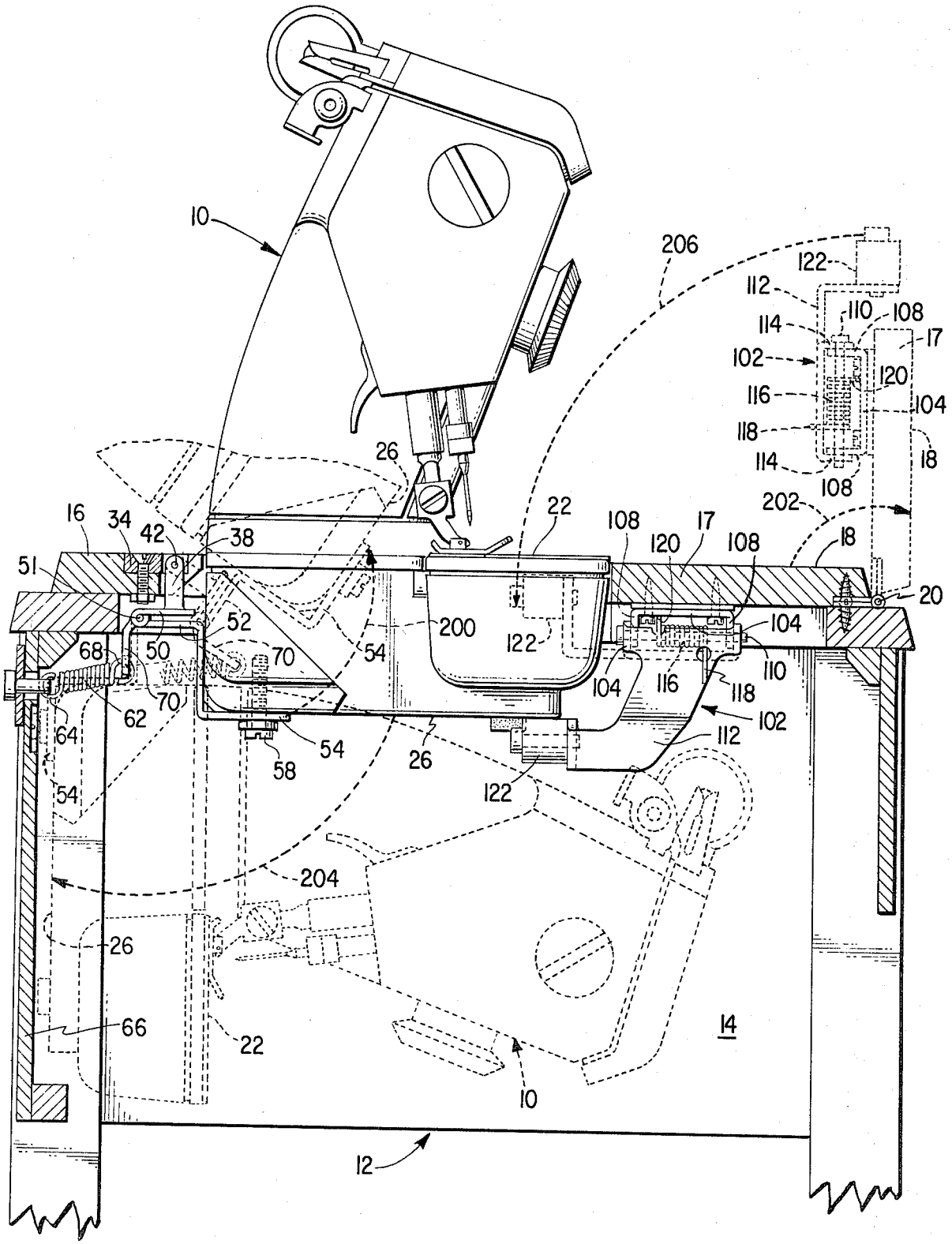
FIG. 2 is a view, partly in section and partly in elevation, taken substantially along the line 2—2 in FIG. 1, showing in solid lines the sewing machine in its operative position and in phantom lines the stored and intermediate positions of the sewing machine and cabinet.

As shown in FIG. 1, and also in FIG. 2, the bed 22 of the sewing machine 10 does not have an overhanging lip which may be used for supporting the sewing machine 10. Instead, the sewing machine 10 must be supported from the underside of the base 26, which is a substantial distance below the bed 22 and the supporting arrangement must extend into the cavity 14 so that when the sewing machine 10 is in its operative position the bed 22 is substantially coplanar with the work supporting surfaces 16 and 18. At the same time, the supporting arrangement must allow clearance for the sewing machine 10 when it is stored within the cavity 14.

Figure 3:
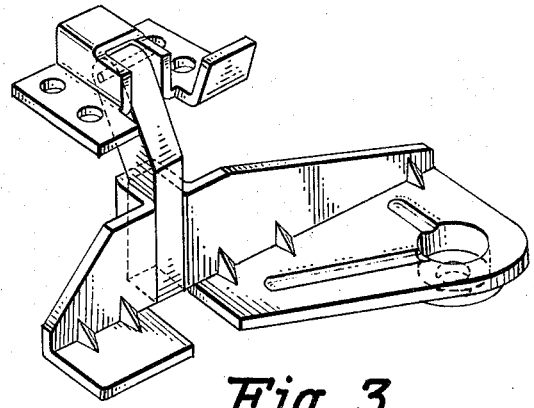
FIG. 3 shows a modification to a portion of the arrangement shown in FIG. 1.

In accordance with the principles of this invention, to support the sewing machine 10 in a preexisting cabinet 12 there is provided a support bracket assembly mounted on the cabinet 12 and extending into the cavity 14. The support bracket assembly includes a pair of support brackets 30 and 32 suspended from hinge assemblies 34 securely mounted with respect to the fixed work supporting surface 16. In the cabinet 12 shown in FIG. 1, the hinge assemblies 34 are of the type known as acorn hinges which normally have a pin having one end mounted for pivoting movement in a notch 34, the other end of which conventionally extends into a socket formed in the rear lip of a flat bed sewing machine for which the cabinet 12 is designed. To accommodate the sewing machine 10, the bracket 30 includes a pin 38 having a hole 40 extending therethrough. A hinge pin 42 extends through a hole 44 in the hinge assembly 34, through the hole 40 and through a hole 46 in the hinge assembly 34 so as to mount the pin 38 for pivoting movement in the notch 36. The pin 38 is affixed to a plate 50 which in turn is hingedly connected to a member 52. The member 52 is preferably formed of sheet stock and is bent so as to extend into the cavity 14 with a lower portion 54 having a recess 56 therein for accepting a rubber foot mounted on the lower surface 26 of the sewing machine 10. A screw 58 extends through a hole in the recess 56, through the rubber foot location (the rubber foot being removed) and into a threaded hole 60 in the base of the sewing machine to secure the sewing machine to the bracket arm 30. The bracket arm 32 is constructed similarly to the aforedescribed bracket arm 30. It will be noted from FIG. 2 that the bracket arm 30, as well as the bracket arm 32, extends sufficiently into the cavity 14 so that when the sewing machine 10 is affixed thereto and in its operative position, the bed 22 of the sewing machine is substantially coplanar with the work supporting surfaces 16 and 18. The bracket assembly 30 also includes a spring 62 having a first end 64 connected to the rear wall 66 of the cabinet 12 and a second end 68 connected to an extension 70 of the plate 50. The purpose of the spring 62 is to prevent both the pivots of the support bracket assembly (i.e., the hinge pins 42 and 51) from acting simultaneously. Accordingly, by the support bracket assembly including the bracket arms 30 and 32, the sewing machine 10 is mounted on the cabinet 12 for pivoting motion. FIG. 3 shows a modification of the support bracket assembly where the cabinet 12 is of the type having what is termed a boomerang hinge instead of an acorn hinge. Since the boomerang hinge has more freedom of motion than the acorn hinge, only one pivot point and no spring is required.

To support the front end of the sewing machine 10, there is provided a support arm assembly, designated generally by the reference numeral 102. The support arm assembly 102 includes a plate member 104 having screw holes 106 for attaching the support arm assembly to the underside of the hinged flap 17. The plate member 104 also includes a pair of spaced apart extensions 108 which are bent to extend substantially at right angles from the surface of the hinged flap 17 to which the plate member 104 is attached. These extensions 108 have openings therethrough through which a hinge pin 110 extends. The support arm assembly 102 also includes a support arm 112 having transversely bent extensions 114 which span the extensions 108 and have openings therein through which the hinge pin 110 also extends. A torsion spring member 116 surrounds the hinge pin 110 and has a first extending end 118 bearing against the support arm 112 and a second extending end 120 bearing against the plate member 104 so as to urge the support arm 112 into the position shown in phantom lines where it is substantially parallel to the undersurface of the hinged flap 17. The support arm assembly 102 further includes a roller 122 mounted on the end of the support arm 112 which is away from the hinged end thereof. The roller 122 is adapted for direct contact with the lower surface 26 of the sewing machine 10 to allow relative motion between the sewing machine 10 and the support arm 112.

Assuming that the sewing machine 10 is in its operative position, as shown in solid lines, if the operator desires to move the sewing machine 10 from its operative position to its stored position, first the sewing machine is pivoted back and up about the pins 42 as shown by the dashed arrow 200. When the weight of the front end of the sewing machine 10 is removed from the roller 122, the torsion spring 118 forces the support arm 112 to be moved from its extended position, as shown in solid lines, to a retracted position substantially parallel to the lower surface of the hinge flap 17, as shown in phantom lines. The operator next pivots the hinged flap 17 upward about the hinges 20, as shown by the dashed arrow 202, to allow clearance for the sewing machine 10. Next, the sewing machine 10 is lowered into the cavity 14 by first pivoting the sewing machine 10 about the pin 42 back to its operative position and then about the hinge pin 51 to the stored position shown in phantom, as indicated by the dashed arrow 204. Finally, the hinged flap 17 is lowered, as shown by the dashed arrow 206, to a position where the surface 18 is again substantially coplanar with the surface 16. The cover member 24 may then be moved to conceal from view the sewing machine 10 within the cavity 14. Since there is no weight on the roller 122, the support end 112 remains in its retracted position and does not interfere with the sewing machine 10 while in its stored position.

Accordingly, there has been described an arrangement for adapting a sewing machine cabinet designed to support a sewing machine of the type having a bed forming an overhanging lip so that the cabinet can support a sewing machine of the convertible bed type for flat bed sewing. It is understood that the above-described embodiment is merely illustrative of the application of the principles of this invention. Numerous other embodiments may be devised by those skilled in the art without departing from the spirit and scope of this invention, as defined by the appended claims.

We claim:

1. In a sewing machine cabinet of the type having a cavity for storing a sewing machine when not in use, a fixed work supporting surface, and a hinged flap having another work supporting surface, said hinged flap being adapted to be upwardly pivoted from a position where said hinged flap work supporting surface is substantially coplanar with said fixed work supporting surface so as to allow a sewing machine to be pivoted between a stored position within said cavity and an operative position with its bed substantially coplanar with said fixed work supporting surface, an arrangement for supporting said sewing machine from the base thereof a substantial distance below the sewing machine bed comprising:

a support bracket assembly mounted on said cabinet and extending into said cavity, said support bracket assembly including means for fixedly mounting said sewing machine base thereon and pivot means for defining the pivoting motion of said sewing machine between said stored and operative positions; and a support arm assembly mounted on said hinged flap, said support arm assembly including a support arm adapted to be extended to a first position so as to support said sewing machine base when said hinged flap work supporting surface is substantially coplanar with said fixed work supporting surface and said sewing machine is in its operative position, said support arm assembly further including means for automatically retracting said support arm to a second position when said sewing machine is moved from its operative position so as to provide clearance for said sewing machine when said sewing machine is in its stored position and said hinged flap work supporting surface is substantially coplanar with said fixed work supporting surface.

2. The arrangement according to claim 1 wherein said support arm assembly further includes a plate member mounted on said hinged flap and a hinge pin mounted on said plate member, said support arm being mounted on said hinge pin for pivotal motion about the axis of said hinge pin, and said retracting means includes a torsion spring surrounding said hinge pin and having a first extending end bearing against said support arm and a second extending end bearing against said plate member so as to urge said support arm toward said second position.

3. The arrangement according to claim 2 wherein said support arm assembly further includes a roller mounted on said support arm for direct contact with said sewing machine base to allow relative motion between said sewing machine base and said support arm during movement of said support arm between said first and second positions.

4. The arrangement according to claim 1 wherein said pivot means of said support bracket assembly includes:

a first pivoting member mounted on said fixed work supporting surface for pivoting motion with respect thereto; and a second pivoting member mounted on said first pivoting member for pivoting motion with respect thereto, said second pivoting member being fixedly connected to said sewing machine base mounting means;

said first pivoting member defining the pivoting motion of said sewing machine above said operative position outside said cavity and said second pivoting member defining the pivoting motion of said sewing machine below said operative position within said cavity.

* * * * *